United States Patent [19]

Engels

[11] 4,424,613

[45] Jan. 10, 1984

[54] APPARATUS FOR BRUSHING PILE FABRIC

[75] Inventor: Walter Engels, Tryon, N.C.

[73] Assignee: Milliken Research Corporation, Spartanburg, S.C.

[21] Appl. No.: 400,563

[22] Filed: Jul. 21, 1982

Related U.S. Application Data

[62] Division of Ser. No. 224,753, Jan. 13, 1982, Pat. No. 4,388,750.

[51] Int. Cl.[3] ..... D06C 27/00

[52] U.S. Cl. ..... 26/2 R

[58] Field of Search ..... 26/2 R, 27, 75, 88, 26/98, DIG. 1; 38/143; 15/308; 226/15

[56] References Cited

U.S. PATENT DOCUMENTS

| | | | |
|---|---|---|---|
| 1,619,814 | 3/1927 | Fisher | 26/27 UX |
| 1,974,400 | 9/1934 | Knowland et al. | 26/2 R |
| 1,975,466 | 10/1934 | Knowland et al. | 26/2 R |
| 2,078,380 | 4/1937 | Guyler et al. | 26/98 X |
| 3,034,193 | 5/1962 | Parker et al. | 26/2 R |
| 3,142,107 | 7/1964 | Wittig | 26/98 |
| 3,419,944 | 1/1969 | Santore | 26/98 |
| 3,438,139 | 4/1969 | Holm | 26/98 X |
| 3,477,109 | 11/1969 | Oonishi et al. | 26/2 R |
| 3,879,817 | 4/1975 | Becker | 26/98 |
| 4,034,446 | 7/1977 | Rubaschek et al. | 26/27 X |
| 4,274,182 | 6/1981 | Greenway | 26/2 R |
| 4,308,649 | 1/1982 | Gilpatrick et al. | 26/2 R |

*Primary Examiner*—Robert Mackey

*Attorney, Agent, or Firm*—Earle R. Marden; H. William Petry

[57] ABSTRACT

Method and apparatus for brushing the pile of a pile fabric and removing wrinkles in a running web of the material by the use of rotating members on the selvedges of the fabric in conjunction with vacuum pressure to urge the selvedges outward and to slightly overfeed the fabric.

6 Claims, 5 Drawing Figures

APPARATUS FOR BRUSHING PILE FABRIC

This is a division of application Ser. No. 224,753, filed Jan. 13, 1982 now U.S. Pat. No. 4,388,750 granted June 21, 1983.

In the take-up of certain fabrics, especially synthetic fabrics in the greige, wrinkles will develop in the fabric, which, if not eliminated, will be set in the fabric. When such a wrinkle is set in the fabric, this portion of the fabric will have to be cut out and either sold as seconds or scrapped.

Therefore, it is an object of the invention to provide a method and apparatus to remove wrinkles in the fabric before the wrinkles have any opportunity to be set in the fabric.

Other objects and advantages of the invention will become readily apparent as the specification proceeds to describe the invention with reference to the accompanying drawings, in which.

Figure 1:
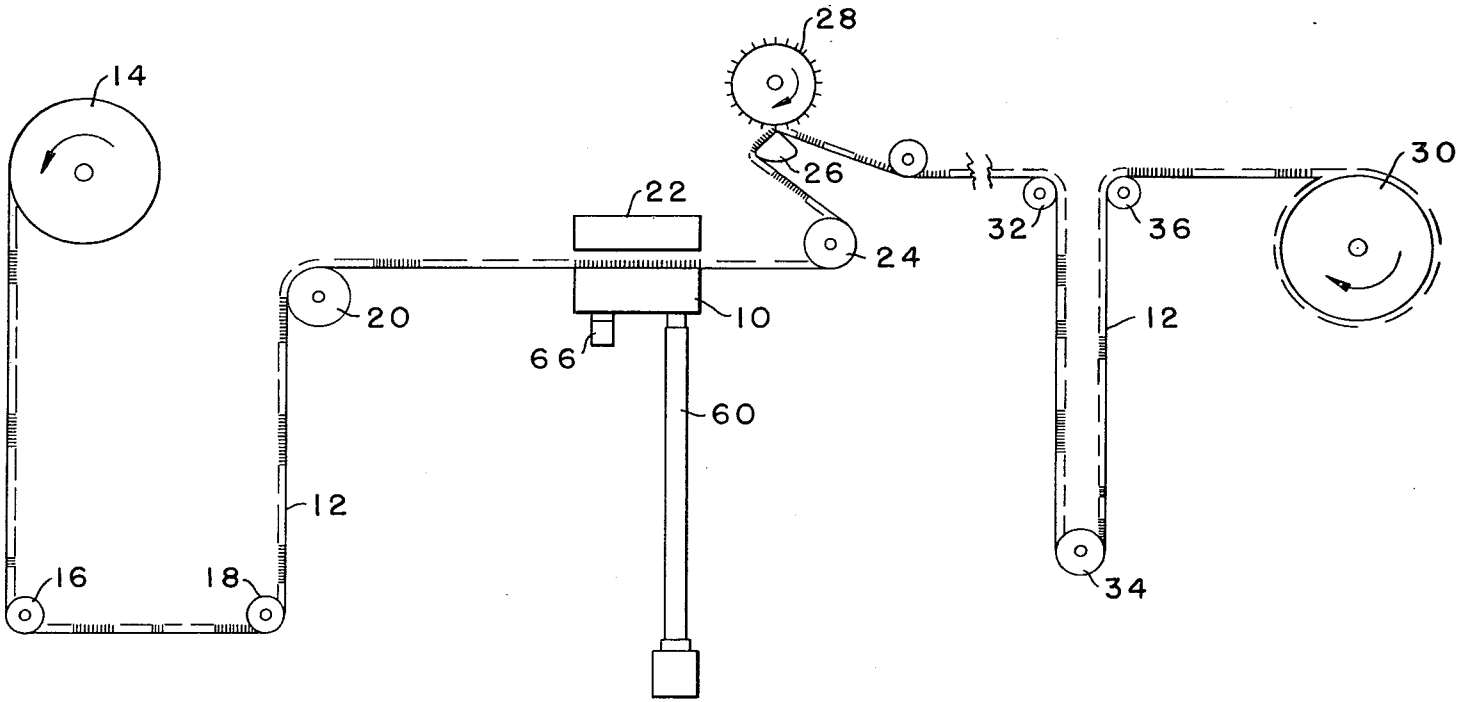
FIG. 1 is a schematic representation of the processing of a web material.
Figure 2:
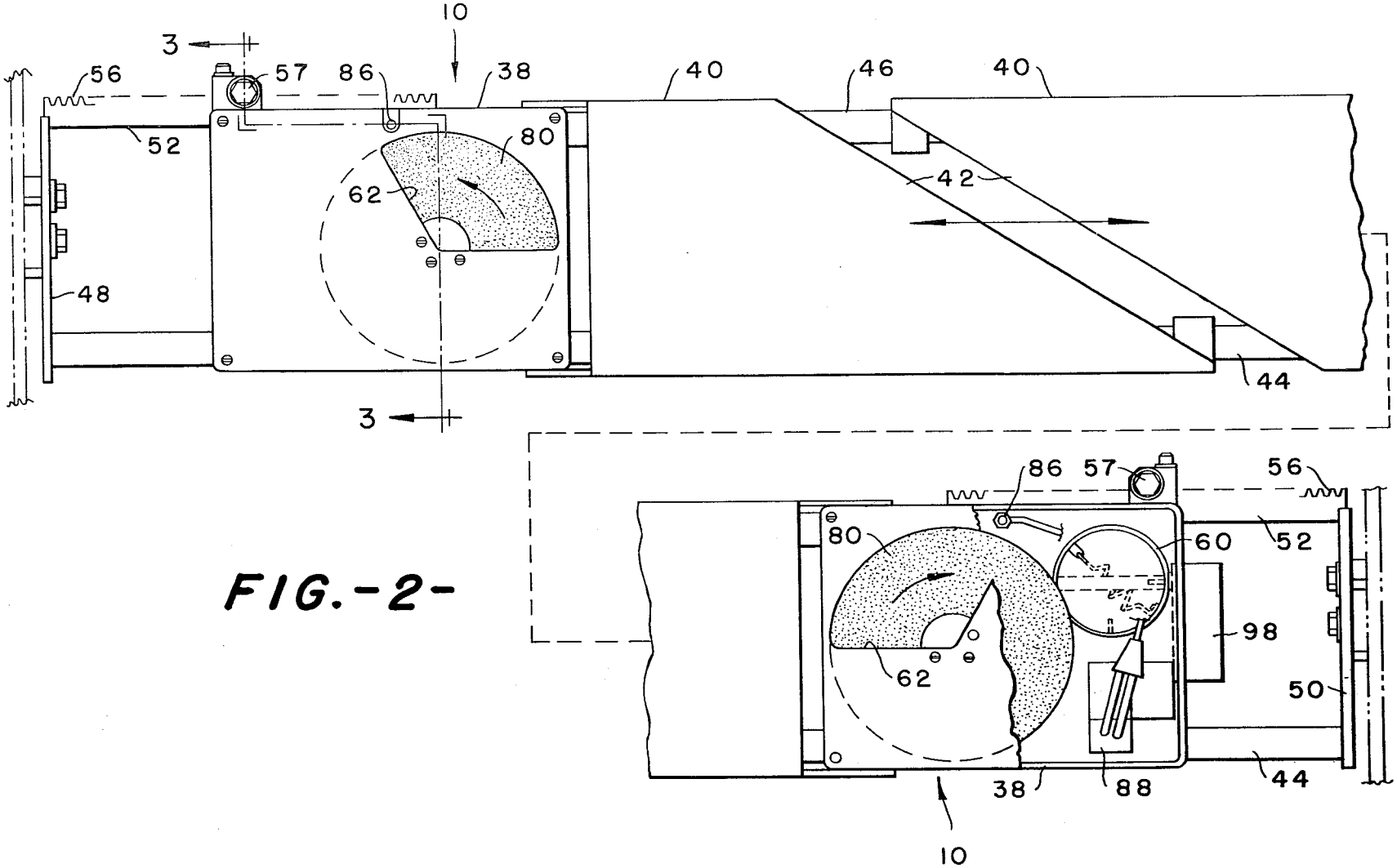
FIG. 2 is a top view of the de-wrinkling device shown in FIG. 1.

FIG. 1 represents schematically one process in which the apparatus shown specifically in FIGS. 2–5 is used to control the wrinkling of a fabric. In the preferred form of the invention, the fabric wrinkle remover 10 is employed to remove wrinkles from an acrylic pile fabric 12 to be brushed on a brushing machine to raise the pile thereof. The fabric 12 is supplied from a supply roll 14 over a pair of idler rolls 16 and 18 by a drive roll 20 to the wrinkle remover 10 whereat the pile of the fabric is heated by the infra-red heater 22 as the wrinkles in the fabric are removed prior to brushing. From the wrinkle remover 10, the fabric 12 is delivered by a feed roll 24 over a guide reversing bar 26 to place the pile of the fabric into contact with the bristles of the brush 28. From the rotating brush 28 the fabric 12 can be delivered to a multiplicity of brushes (not shown) to further condition the pile prior to delivery to the take-up roll 30 over rolls 32, 34 and 36. Preferably, the wrinkle remover 10 is located prior to the first brush 28 but subsequent wrinkle removers 10 can be employed, if desired, or necessary.

As briefly discussed before, wrinkles tend to form in a running web of material, especially pile fabric, and tend to remain when the fabric is set. This is especially true of pile acrylic fabrics which are heated prior to brushing of the pile and then allowed to cool upon take-up. When this happens, the wrinkled areas of the fabric normally have to be cut out upon inspection. To alleviate this situation, the wrinkle remover 10 has been provided to remove the wrinkles in the fabric 12 prior to brushing so, that with the use of proper spreader rolls, the fabric is maintained in an unwrinkled condition during processing.

The wrinkle remover 10 basically consists of a pair of rectangular spreader boxes 38 which are located at the extremities of the fabric 12. Each spreader box is connected to a U-shaped metal member 40 having mating slanted edges 42 which provide a supporting surface for the center portion of the fabric 12. Each of the combined spreader boxes 38 and members 40 are slidably mounted on guide shafts 44 and 46. The guide shaft 44 extends the full width of the wrinkle remover 10 and is connected to the end plates 48 and 50. The guide shaft 46 is shorter than the shaft 44 and has rack members 52 connected thereto at each end. Each of the rack members 52 are connected at one end to either the end plate 48 or 50. Rotatably mounted to the rear of each spreader box 38 is a pinion gear 54 which engages the teeth 56 of the rack 52. The pinion gear 54 rotates in a bearing 58 fixed to the housing of the spreader box and has the upper end thereof shaped in the form of a screw head. Then, depending on the width of the fabric 12 to be run, the pinion gear 54 in contact with the teeth 56 of the rack 52 is rotated by a suitable tool in contact with the bolt head 57 to move the respective spreader box 38 in or out on the shafts 44 and 46 to adjust the space between the edges 42 thereof.

Figure 3:
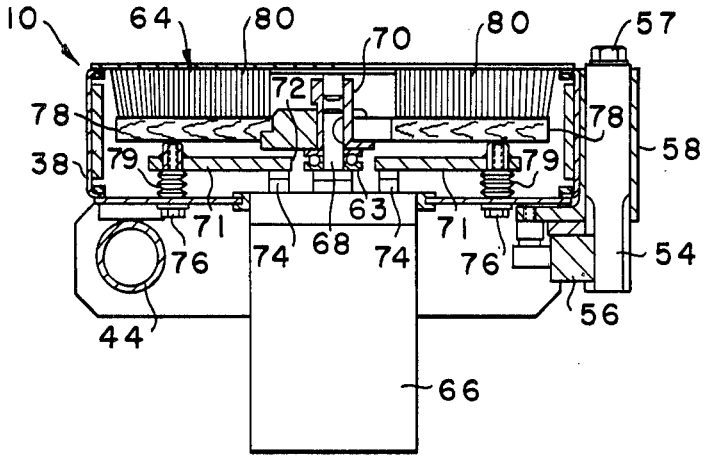
FIG. 3 is a cross-sectional view taken on line 3—3 of FIG. 2.

Each of the spreader boxes 38 are substantially identical as shown in cross-section in FIG. 3 and are connected to a suitable vacuum source through conduit 60. As discussed briefly before, the spreader boxes 38 are substantially rectangular and have a pie-shaped opening 62 in the top thereof. Rotatably mounted in bearings 63 in each spreader box 38 below the opening 62 is a brush 64. Each brush 62 is driven individually by a motor 66, the shaft 68 of which projects upwardly into the hub 70 of the brush 64. Located internally of each spreader box 38 is a plate 71 which has opening 72 therein for the passage of air and which is secured adjacent the opening 72 to the studs 74 on the motor 66. At spaced points around the periphery of the plate 71, bolts 76 are screwed therein and abut the base plate 78 of the brush 64. The bolts 76 are threaded on the upper portion thereof but are not threaded adjacent the head so a plurality of Bellville springs 79 are used to bias the plate 71 upwards. Bolts 76 are employed to urge the brush 64 upwards, periodically as necessary when the bristles 80 of the brush 64 are worn down in use.

Figure 4:
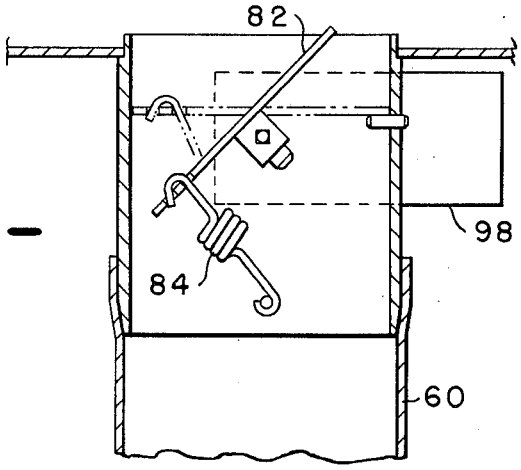
FIG. 4 is a cross-sectional view of the vacuum conduit shown in FIGS. 1 and 2.
Figure 5:
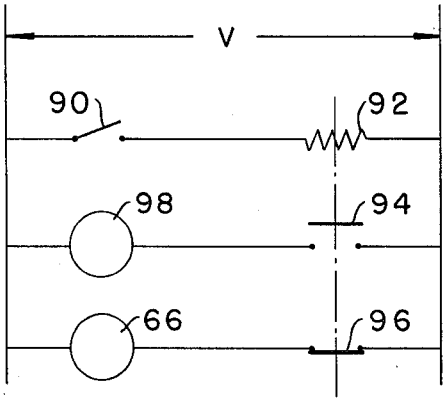
FIG. 5 is a schematic circuit diagram of the selvedge guide control for one spreader box.

As discussed briefly before, vacuum conduit 60, connected to the bottom of each of the spreader boxes 38, sucks air through the opening 62 to pull the fabric 12 down and maintain it in contact with the bristles 80 of the brush 64. FIG. 4 is a cross-section of the conduit 60 with the damper 82 held in the open position by the spring 84. Located in each spreader box 38 is a fiber optic tube 86 which is connected to the photocell 88 operably associated with the switch 90 (FIG. 5). In normal operation, the damper 82 will be open as shown in FIG. 4 and the switch 90 will be open allowing the brush motors 66 to operate and rotate the brushes. Looking now to FIG. 5, which illustrates a control circuit which is the same for each spreader box 38, the switch 90 is open and the brush motor 66 is energized. If the fabric 12 is displaced either to the right or to the left far enough to where the fiber optic tube 86 is covered, the photocell 88 will close switch 90 and energize the coil 92. Energization of the coil 92 will close switch 94 and open switch 96 to energize the damper motor 98 and de-energize the brush motor 66. When this happens, the brush action on the other side of the wrinkle remover 10 will pull the fabric sideways until it is properly located and the optic tube 86 is uncovered to reverse the action of the switch 90. It can be seen that activation of the motor 98 will rotate the damper 82 close to the dotted line position shown in FIG. 4 to cut off the suction to the fabric 12. Simultaneously, the brush 64 will cease to rotate so that the fabric 12 is released to allow the other spreader box to act to correct the position of the fabric.

OPERATION

In the preferred embodiment of the invention, the wrinkle remover 10 is employed to remove the wrinkles from a heated pile fabric being supplied to a brushing machine. As discussed, the position of the spreader boxes is adjusted to accommodate the width of the fabric being run. As the fabric is being supplied over the boxes 38, the brushes 64 will cam the fabric outward to remove the wrinkles therein as the suction pressure from the conduit 60 pulls the fabric downward thereagainst. At the same time, the brushes tend to slightly overfeed the fabric as it is being supplied to the brush 28. As hereinbefore explained, if the fabric should wander to the right or to the left, it will be automatically repositioned by the cooperation of the two spreader boxes and the control circuit associated therewith.

It is obvious that an apparatus has been described which will automatically remove the wrinkles from a moving web of material as it passes thereover to lessen the tendency of the fabric to have wrinkles set therein after it has been processed. The over-feeding of the fabric, especially a knit fabric, is important since a knit fabric tends to stretch, reducing the number of courses per inch in the finished fabric, and the over-feeding of such a fabric tends to maintain the desired number of courses per inch.

Although the preferred embodiment of the invention has been described, it is contemplated that changes may be made without departing from the scope or spirit of the invention and I desire to be limited only by the scope of the claims.

I claim:

1. A machine to brush the pile fabric comprising: means to supply a pile fabric, means to heat the pile of the pile fabric, means to urge the selvedge of the pile fabric in an outward direction to remove the wrinkles therefrom, means to brush the pile of the pile fabric and means to take up the pile fabric, said means to urge the selvedge of the pile fabric in an outward direction including an elongated hollow member and a spreader box mounted on each end of said elongated hollow member, each of said spreader boxes having an opening in the top thereof and a rotating brush therein, means operably associated with each of said brushes urging said brushes towards said opening, and means to rotate said brush mounted on said spreader box, each of said spreader boxes having a suction conduit operably associated therewith.

2. The machine of claim 1 wherein said elongate member is in at least two sections with one section connected to one of said spreader boxes and the other section is connected to the other of said spreader boxes.

3. The machine of claim 2 wherein said wrinkle remover includes an adjusting means to allow each of said sections to be moved towards and away from each other.

4. The machine of claim 3 wherein said adjusting means includes a rack and pinion arrangement operably associated with each of said spreader boxes.

5. The machine of claim 4 wherein each of said suction conduits have a damper therein, a web detection device mounted on the top of each of said spreader boxes and a control circuit operably associated with said web detection devices to close said damper and stop said means to rotate said brush when the web material is detected by said web detection devices.

6. The machine of claim 1 wherein each of said suction conduits have a damper therein, a web detection device mounted on the top of each of said spreader boxes and a control circuit operably associated with said web detection devices to close said damper and stop said means to rotate said brush when the web material is detected by said web detection devices.

* * * * *